US006303554B1

(12) United States Patent
Casati et al.

(10) Patent No.: US 6,303,554 B1
(45) Date of Patent: Oct. 16, 2001

(54) PLASTIC SURFACE CLEANING USING A KOH/ALCOHOL SOLUTION

(75) Inventors: Donato Casati, Merate; Fabio Mauri, Bernareggio; Silvano Passagrilli, Casatenovo, all of (IT)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/593,043

(22) Filed: Jun. 13, 2000

Related U.S. Application Data

(62) Division of application No. 09/362,604, filed on Jul. 28, 1999, now abandoned.

(30) Foreign Application Priority Data

Dec. 16, 1998 (GB) ..... 9827563

(51) Int. Cl.[7] ..... C11D 7/06; C11D 3/43

(52) U.S. Cl. ..... 510/243; 510/175; 510/176; 510/182; 510/225; 510/233; 510/252; 510/271; 510/272; 510/401; 510/432

(58) Field of Search ..... 427/304; 510/175, 510/176, 182, 225, 233, 243, 252, 271, 272, 407, 432

(56) References Cited

U.S. PATENT DOCUMENTS 4,740,562 * 4/1988 Menke et al. ..... 525/366

* cited by examiner

*Primary Examiner*—Mark Kopec
*Assistant Examiner*—Charles Boyer
(74) *Attorney, Agent, or Firm*—Connolly Bove Lodge & Hutz; Lawrence R. Fraley

(57) ABSTRACT

A method for pretreating a plastic surface in a coating process. The plastic surface is immersed in a solution containing iso-propanol, or another light alcohol, and potassium hydroxide (KOH). The method and the solution according to the present invention are particularly useful for cleaning and etching plastic surfaces (e.g. PU or PVC) with a heavy organic chemical contamination (e.g. silicone).

19 Claims, No Drawings

PLASTIC SURFACE CLEANING USING A KOH/ALCOHOL SOLUTION

CROSS REFERENCE TO RELATED APPLICATION

This application is a divisional of U.S. patent application Ser. No. 09/362,604 filed Jul. 28, 1999 abandoned.

TECHNICAL FIELD

The present invention relates to a method and a solution for cleaning a plastic surface, more particularly the present invention relates to a double action cleaning and etching method in a process for coating a plastic surface.

BACKGROUND ART

In industrial manufacturing processes it is usual that plastic parts be required to be painted or coated, not only for decorative purposes, but also for a number of functional reasons, e.g. for improving mechanical and chemical resistance (i.e. anti-scratch and anti-reflection coating for CR-39 optical lens), electro static discharge (ESD) and/or magnetic frequency interference (MFI) shielding (polymer metalization).

Very often, plastic surfaces have a poor tendency to bond to other materials and offer low adhesion characteristics, making the painting process of the surface very difficult, because of the bad interaction of the plastic surface with the coating layer.

The main reason for the low adhesion between plastic surfaces and coatings is the inherent inert chemical structure of polymers, which gives a low surface energy, and the presence of additives in their chemical composition, such as plasticizers, antioxidants and antistatics.

For this reason, a plastic surface needs a pretreatment (e.g. an etching treatment) to facilitate adhesion with the coating layer. This pretreatment has the effect of activating the polymer surface and increasing the surface energy of the plastic substrate.

Further problems may be caused by external agents also known as mold release agents, which are often present on the surface of plastic molded parts. Some of these agents, e.g. silicones and waxes, can hinder adhesion dramatically, and are usually very resistant to any cleaning process.

Those skilled in the art will appreciate that a number of cleaning and etching methods are known for pretreating plastic surfaces. These methods can be divided into mechanical method (e.g. sand blasting, grinding, brushing); physical method (e.g. plasma etching, corona, flame, UV-ozone); chemical methods (e.g. solvents, acidic and alkaline aqueous solution). The choice of the cleaning method can depend upon many factors, e.g the expected degree of cleanliness or the original level of contamination of the part, chemical and physical compatibility with the surface to be treated, the size and the shape of the parts to be treated.

None of the known methods however provides effective cleaning and etching combined action, particularly when the plastic surface to be treated presents a heavy organic chemical contamination (e.g. silicones).

U.S. Pat. No. 4,426,253 discloses a process for rapidly etching a polyimide film. The process described therein uses an aqueous solution of ethyl or propyl alcohol containing a basic compound. The addition of alcohol to the solution results in an etching action 400 times faster than the simple aqueous basic solution without the alcohol. This solution however would be not very effective on a plastic surface with a heavy contamination by organic (e.g. silicones) material, because of the bad compatibility between water and silicones; silicones are known to be hydrophobic materials.

The present invention has the object to provide a technique which alleviates the above drawbacks.

SUMMARY OF THE INVENTION

According to the present invention, we provide a water-free solution for cleaning a plastic surface, said solution comprising potassium hydroxide (KOH) dissolved in a compound selected from the group consisting of alcohols.

Further, according to the present invention, we provide a method for cleaning and etching a plastic surface, the method comprising the step of: treating the plastic surface with a solution comprising potassium hydroxide (KOH) dissolved in a compound selected from the group consisting of alcohols.

DETAILED DESCRIPTION OF A PREFERRED EMBODIMENT

According to a preferred embodiment of the present invention the plastic material to be cleaned and pre-treated is immersed in a KOH (potassium hydroxide) iso-propanol solution prepared by dissolving KOH in iso-propanol. For good results the concentration of KOH should be more than 10 g/l. According to a preferred embodiment the concentration of KOH is 56.1 g per liter (1N concentration). Any other light alcohol capable of dissolving KOH could be used instead of iso-propanol, e.g. n-propanol, methanol or ethanol.

The plastic part is kept immersed in the above described solution for a few minutes. According to a preferred embodiment of the present invention the immersion time is about 10 minutes and the part is maintained under constant mechanical agitation. Alternative ways of agitation may also be employed (e.g. ultrasonic).

Other ways of treating the plastic surface with the above described solution may be used instead of the immersion, eg. spraying.

After the treatment with the solution, the plastic surface is thoroughly rinsed; according to a preferred embodiment of the present invention, the part is rinsed using running DI water until the pH of water drops on the surface become neutral (reaching a value around 7, measured by indicator paper). Then the surface is dried (e.g. under dry air or nitrogen flow). A possible alternative would be to rinse the plastic surface with iso-propanol; in this case the drying operation would be much faster.

To obtain better results, the immersion (or spraying) , rinsing and drying operations should be repeated one or more times. According to a preferred embodiment of the present invention, the surface is immersed a second time into a new, freshly prepared, KOH iso-propanol solution and kept immersed for 5 minutes under constant agitation. Rinsing and drying operations are repeated as well.

For better results, after the treatment, the plastic part should be properly stored and conserved (e.g. sealed in a plastic bag) and, ideally, painted or coated within 24 hours.

As mentioned above, the chemical and physical compatibility of the treating solution with the plastic surface to be treated must be considered. As an example, the above described solution is particularly indicated for cleaning and etching rigid polyurethane (PU) and polyvinylchloride (PVC). In general the solution of the present invention may be used on all those materials which offer a good chemical resistance to alcohols and alkali, while it would not be appropriate on materials like e.g. polycarbonate or polymethylmethacrylate which exhibit poor resistance to organic solvents.

The above described treatment is particularly useful for treating plastic molded parts before they are painted. The treatment has a double action effect: vigorous surface cleaning of the plastic surface from "mold release agents"; and good chemical etching even in the presence of silicone compounds.

The cleaning and etching action provided by the solution and method of the present invention is much more efficient than the prior art solutions and methods. The main reason is the low surface energy of the solution; this is due to the absence of water. The low surface energy of a cleaning solution becomes a fundamental feature when the parts to be treated include intricate geometries. For the above reason the solution of the present invention gives better results than any aqueous solution of the prior art.

The above described solution and method may be used also for cleaning plastic surfaces when the surfaces do not need to be activated, with an etching action, in coating or painting processes. As an example, all the "clean room" applications (e.g. in the electronic or biomedical field), where a very high degree of cleanliness is required, may benefit by the cleaning action of the solution and method of the present invention

What is claimed is:

1. A method for cleaning and etching a plastic surface selected from the group consisting of polyurethane and polyvinylchloride, which comprises:

treating said plastic surface with a water-free solution comprising potassium hydroxide (KOH) dissolved in an alcohol.

2. The method of claim 1 wherein the concentration of KOH is 56.1 g/l.

3. The method of claim 1 wherein alcohol is iso-propanol ($CH_3CH(OH)CH_3$).

4. The method of claim 1 wherein said treating includes:

immersing the plastic surface in said solution.

5. The method of claim 4 wherein the immersion time is 10 min.

6. The method of claim 1 further comprising:

rinsing the treated part with DI water; and drying the rinsed part with dry air or nitrogen flow.

7. The method of claim 1 further comprising:

rinsing the treated part with iso-propanol; and drying the rinsed part with dry air or nitrogen flow.

8. The method of claim 6 wherein said treating, rinsing and drying are repeated two or more times.

9. The method of claim 1 wherein said water-free solution consists essentially of potassium hydroxide dissolved in an alcohol.

10. The method of claim 1 wherein said plastic is a polyurethane.

11. The method of claim 1 wherein said plastic is polyvinyl chloride.

12. A method for cleaning and etching a plastic surface, which comprises:

treating the plastic surface with a water-free solution which consists of potassium hydroxide (KOH) dissolved in an alcohol.

13. The method of claim 12 wherein the concentration of KOH is 56.1 g/l.

14. The method of claim 12 wherein the alcohol is iso-propanol ($CH_3CH(OH)CH_3$).

15. The method of claim 12 wherein treating includes:

immersing the plastic surface in said solution.

16. The method of claim 15 wherein the immersion time is 10 min.

17. The method of claim 12 further comprising:

rinsing the treated part with DI water; and drying the rinsed part with dry air or nitrogen flow.

18. The method of claim 12 further comprising:

rinsing the treated part with iso-propanol; and drying the rinsed part with dry air or nitrogen flow.

19. The method of claim 17 wherein the treating, rinsing and drying are repeated two or more times.

* * * * *